US005745035A

United States Patent [19]

Deyo

[11] Patent Number: 5,745,035

[45] Date of Patent: Apr. 28, 1998

[54] MOTION DETECTING SYSTEM

[76] Inventor: David W. Deyo, 1208 Collin Dr., Allen, Tex. 75002

[21] Appl. No.: 803,427

[22] Filed: Feb. 20, 1997

[51] Int. Cl.[6] ..... G08B 13/00

[52] U.S. Cl. ..... 340/541; 340/562; 340/567; 340/815.45

[58] Field of Search ..... 340/541, 550, 340/551, 552, 553, 554, 555–557, 561–563, 565, 567, 815.45, 825.31; 367/93, 117

[56] References Cited

U.S. PATENT DOCUMENTS

| | | | |
|---|---|---|---|
| 3,801,978 | 4/1974 | Gershberg et al. | 340/522 |
| 4,144,529 | 3/1979 | Miller et al. | 340/562 |
| 4,166,273 | 8/1979 | Riley, Jr. et al. | 340/541 |
| 4,218,763 | 8/1980 | Kelley et al. | 340/541 |
| 4,520,349 | 5/1985 | Varano | 340/541 |
| 5,015,994 | 5/1991 | Hoberman et al. | 340/567 |
| 5,128,654 | 7/1992 | Griffin et al. | 340/567 |
| 5,570,079 | 10/1996 | Dockery | 340/567 |

*Primary Examiner*—Brent A. Swarthout

[57] ABSTRACT

A motion detecting system including a plurality of transmitter housings. A plurality of motion detector transmitter mechanisms are situated in each of the transmitter housings. Each motion detector transmitter mechanism includes a motion detector adapted to emit a motion signal upon the detection of motion, a transmitter adapted to emit a transmitter activation signal via free space upon the transmission of the motion signal and only during the receipt of power, and a one-shot multivibrator mechanism connected to the motion detector and the transmitter. The one-shot multivibrator mechanism is adapted to transmit power for a predetermined amount of time upon the receipt of the motion signal. Further provided is a receiver unit including a housing and a receiver mechanism. The receiver mechanism includes a receiver adapted to accept the transmitter activation signal via free space. At least one light emitting diode is situated on the receiver housing and is connected to the receiver for indicating the detection of motion by at least one of the motion detector transmitter mechanisms.

6 Claims, 4 Drawing Sheets

MOTION DETECTING SYSTEM

BACKGROUND OF THE INVENTION

1. Field of the Invention

The present invention relates to a motion detecting system and more particularly pertains to alerting a user of motion being detected in various areas and further indicating in which area motion is detected.

2. Description of the Prior Art

The use of motion detectors is known in the prior art. More specifically, motion detectors heretofore devised and utilized for the purpose of monitoring motion are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,516,115 to Frigon et al.; U.S. Pat. No. 5,371,489 to Carroll et al.; U.S. Pat. No. 4,275,303 to Mudge; U.S. Pat. No. 4,141,006 to Braxton; U.S. Pat. No. 4,888,581 to Guscott; and U.S. Pat. No. Des. 269,072 to Sweet et al.

In this respect, the motion detecting system according to the present invention substantially departs from the conventional concepts and designs of the prior art, and in so doing provides an apparatus primarily developed for the purpose of alerting a user of motion being detected in various areas and further indicating in which area motion is detected.

Therefore, it can be appreciated that there exists a continuing need for a new and improved motion detecting system which can be used for alerting a user of motion being detected in various areas and further indicating in which area motion is detected. In this regard, the present invention substantially fulfills this need.

SUMMARY OF THE INVENTION

In view of the foregoing disadvantages inherent in the known types of motion detectors now present in the prior art, the present invention provides an improved motion detecting system. As such, the general purpose of the present invention, which will be described subsequently in greater detail, is to provide a new and improved motion detecting system which has all the advantages of the prior art and none of the disadvantages.

To attain this, the present invention essentially comprises a plurality of transmitter housings each with a generally rectangular configuration. Each transmitter housing has a front face, a rear face, and a periphery formed therebetween thus defining an interior space. As best shown in FIGS. 1–2, the front face has a lower extent with a semi-cylindrical protrusion protruding therefrom. For allowing communication between the interior space and an exterior, the protrusion has a plurality of horizontal slots formed therein along an entire width of the front face. To allow a user to selectively govern such communication, the protrusion further has a plurality of flexible shutters adapted to selectively cover a predetermined area of the slots. The transmitter housing further includes a rectangular cut out formed in the rear face thereof. Such cut out is for allowing a conventional power plug to be pivotally coupled therein. As shown in FIG. 2, the plug is rotatable about a vertical axis. The horizontal slots may be selectively covered and directed towards various areas upon the plug being inserted within a standard power receptacle. Further provided is a plurality of motion detector transmitter means situated in each of the transmitter housings. As shown in FIG. 5, each motion detector transmitter means includes a motion detector situated within the associated transmitter housing. Such motion detector is adapted to emit a motion signal upon the detection of motion via a portion of the slots uncovered by the shutters. Connected to the motion detector and situated within the associated transmitter housing is a data encoder. The data encoder is adapted to emit a transmitter coded activation signal upon the receipt of the motion signal. It should be noted that each transmitter coded activation signal is unique and corresponds with the associated transmitter housing. Associated with the data encoder is a transmitter which is also situated within the associated transmitter housing. The transmitter is adapted to emit the transmitter coded activation signal via free space upon the receipt thereof only during the receipt of power. Finally, for supplying power to the transmitter, a one-shot multivibrator is situated within the associated transmitter housing and connected to the motion detector and the transmitter. In use, the one-shot multivibrator is adapted to transmit power for a predetermined amount of time upon the receipt of the motion signal. Further provided is a single receiver unit with a housing with a rectangular configuration. As shown in FIG. 4, the housing of the receiver unit has a front face, a rear face, and a periphery formed therebetween thereby defining an interior space. With reference now to FIG. 6, the receiver unit further has receiver means including a receiver adapted to receive the transmitter coded activation signal via free space. A data decoder is situated within the receiver housing and is further connected to the receiver. The data decoder has a plurality of outputs. The data decoder functions to transmit a pulse to one of the outputs thereof upon the receipt of a corresponding transmitter coded activation signal. It should be understood that the duration of the pulse corresponds to the duration of the transmitter coded activation signal. Also included as a component of the receiver means is a flip flop situated within the receiver housing with a plurality of inputs thereof connected to the outputs of the data decoder. The flip flop is further equipped with a plurality of outputs. In operation the flip flop is adapted to transmit a consistent pulse at an output thereof corresponding to the input thereof from which the pulse was received. The flip flop is adapted to emit the pulse from the output thereof until the receipt of a reset pulse received upon the depression of a reset key disposed on the receiver housing of the receiver unit. For providing indication to a user, a plurality of light emitting diodes are situated on the front face of the receiver housing and connected to a corresponding output of the flip flop. Each light emitting diode is adapted for emitting light upon the receipt of a pulse. Associated therewith is a buzzer adapted to emit an audible sound upon the receipt of a pulse. For controlling the buzzer, a 4-input OR gate is connected between the outputs of the flip flop and the buzzer. The OR gate operates to transmit the pulse to the buzzer upon at least one of the outputs transmitting a pulse.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved motion detecting system which has all the advantages of the prior art motion detectors and none of the disadvantages.

It is another object of the present invention to provide a new and improved motion detecting system which may be easily and efficiently manufactured and marketed.

It is a further object of the present invention to provide a new and improved motion detecting system which is of a durable and reliable construction.

An even further object of the present invention is to provide a new and improved motion detecting system which is susceptible of a low cost of manufacture with regard to both materials and labor, and which accordingly is then susceptible of low prices of sale to the consuming public, thereby making such motion detecting system economically available to the buying public.

Still yet another object of the present invention is to provide a new and improved motion detecting system which provides in the apparatuses and methods of the prior art some of the advantages thereof, while simultaneously overcoming some of the disadvantages normally associated therewith.

Still another object of the present invention is to alert a user of motion being detected in various areas and further indicate in which area motion is detected.

Lastly, it is an object of the present invention to provide a new and improved motion detecting system including a plurality of transmitter housings. A plurality of motion detector transmitter mechanisms are situated in each of the transmitter housings. Each motion detector transmitter mechanism includes a motion detector adapted to emit a motion signal upon the detection of motion, a transmitter adapted to emit a transmitter activation signal via free space upon the transmission of the motion signal and only during the receipt of power, and a one-shot multivibrator mechanism connected to the motion detector and the transmitter. The one-shot multivibrator mechanism is adapted to transmit power for a predetermined amount of time upon the receipt of the motion signal. Further provided is a receiver unit including a housing and a receiver mechanism. The receiver mechanism includes a receiver adapted to accept the transmitter activation signal via free space. At least one light emitting diode is situated on the receiver housing and is connected to the receiver for indicating the detection of motion by at least one of the motion detector transmitter mechanisms.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
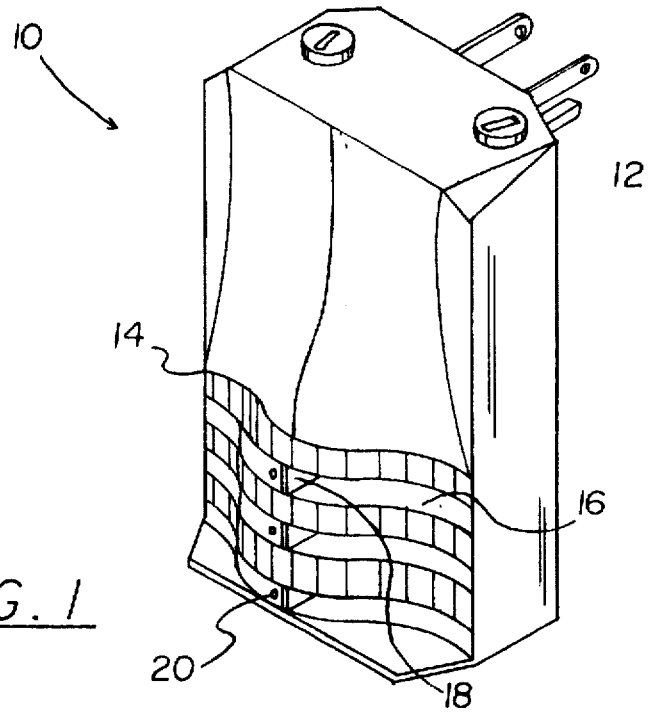
FIG. 1 is a perspective illustration of the preferred embodiment of the motion detecting system constructed in accordance with the principles of the present invention.

With reference now to the drawings, and in particular to FIG. 1 thereof, a new and improved motion detecting system embodying the principles and concepts of the present invention and generally designated by the reference numeral 10 will be described.

The present invention, the new and improved motion detecting system is comprised of a plurality of components. Such components in their broadest context include a plurality of transmitter housings, motion detector transmitter means and a receiver unit. Such components are individually configured and correlated with respect to each other so as to attain the desired objective.

Figure 2:
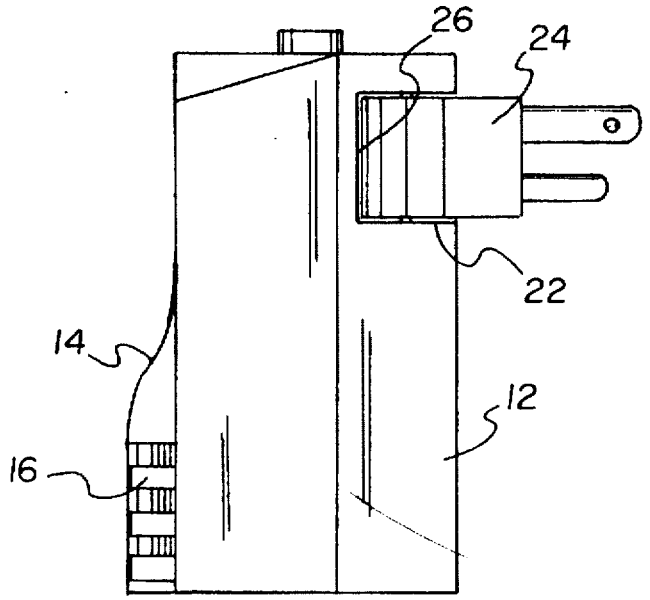
FIG. 2 is a side view of the transmitter housing of the present invention.
Figure 3:
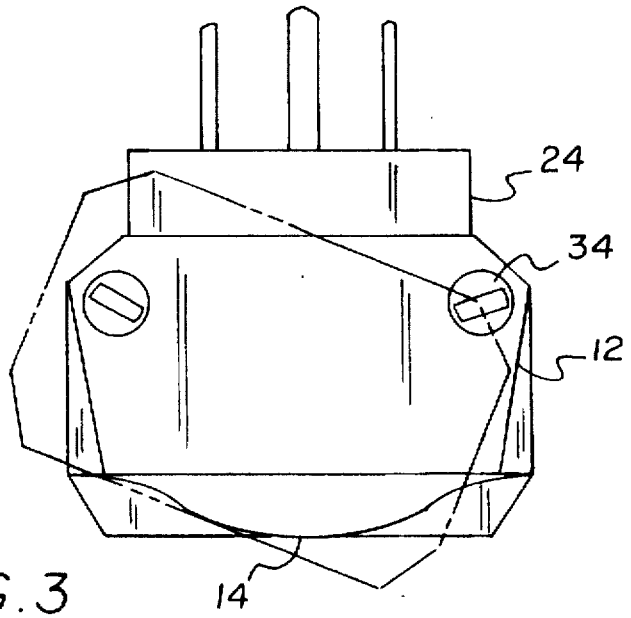
FIG. 3 is a top view of the transmitter housing depicting the pivoting action thereof.

More specifically, it will be noted that the system 10 of the present invention includes a plurality of transmitter housings 12 each with a generally rectangular configuration. Each transmitter housing has a front face, a rear face, and a periphery formed therebetween thus defining an interior space. As best shown in FIGS. 1–2, the front face has a lower extent with a semi-cylindrical protrusion 14 extending outwardly therefrom. For allowing communication between the interior space and an exterior, the protrusion has a plurality of horizontal slots 16 formed therein along an entire width of the front face. To allow a user to selectively govern such communication, the protrusion further has a plurality of flexible shutters 18 adapted to selectively cover a predetermined area of the slots. The shutters are adapted to slide within the slots from one side of the transmitter housing to the other. A divot 20 is provided on the front face of each shutter to facilitate the manual sliding thereof. The transmitter housing further includes a rectangular cut out 22 formed in the rear face thereof. Such cut out is adapted for allowing a conventional power plug 24 to be pivotally coupled therein. As shown in FIG. 2, the plug is rotatable about a vertical axis. Preferably, the plug has an arcuate front face 26 to allow optimal pivoting. By this structure, the horizontal slots may be selectively covered and directed towards various areas upon the plug being inserted within a standard power receptacle.

Figure 5:
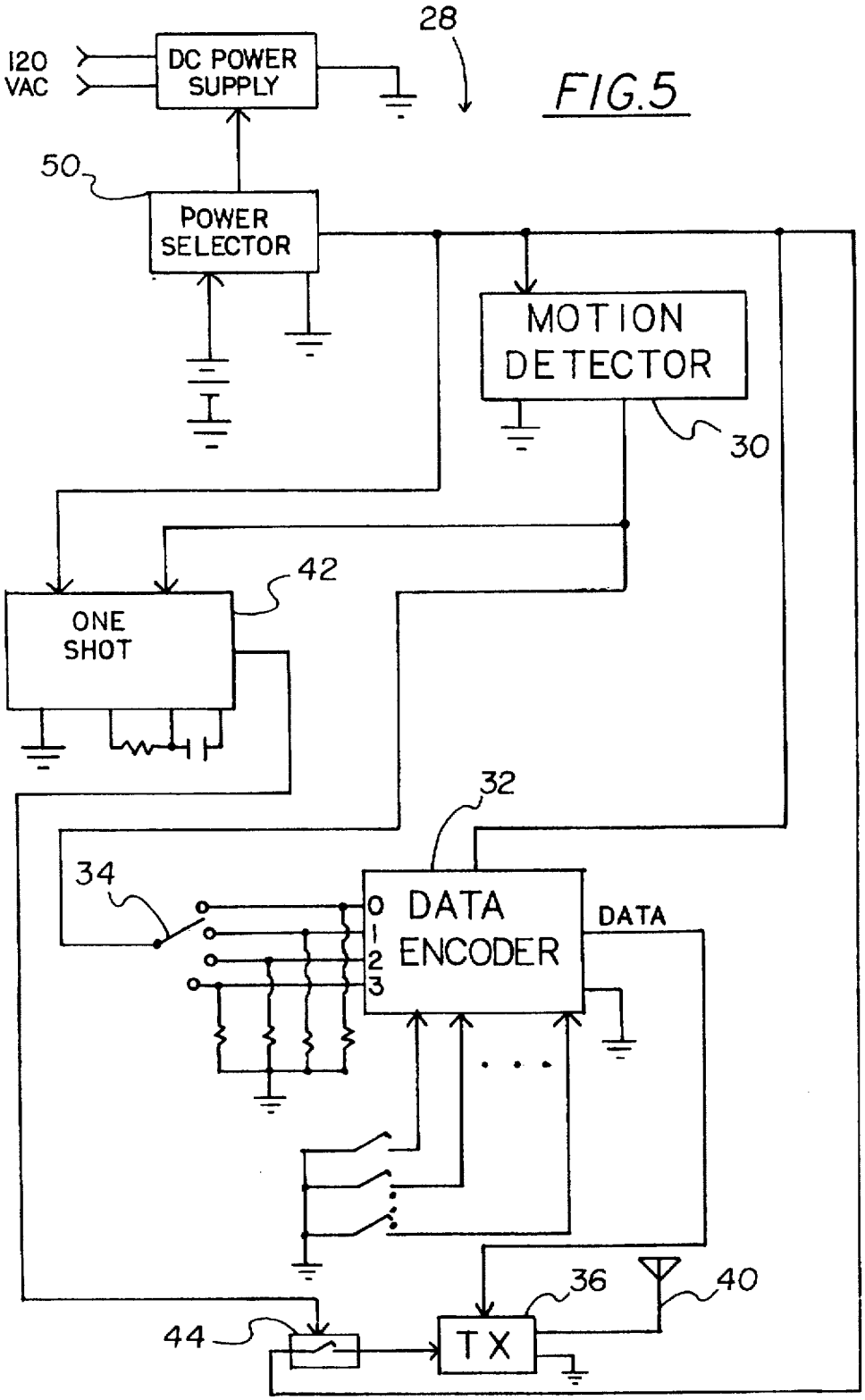
FIG. 5 is a schematic diagram of the motion detector transmitter means of the present invention.

Further provided is a plurality of motion detector transmitter means 28 situated in each of the transmitter housings. As shown in FIG. 5, each motion detector transmitter means includes a motion detector 30 situated within the associated transmitter housing. Such motion detector is adapted to emit a motion signal upon the detection of motion via a portion of the slots uncovered by the shutters. In use, the shutters limit the scope or viewing angle of each motion detector. Connected to the motion detector and situated within the associated transmitter housing is a data encoder 32. The data encoder is adapted to emit a transmitter coded activation signal upon the receipt of the motion signal. It should be noted that each transmitter coded activation signal is unique and corresponds with the associated transmitter housing. As shown in FIG. 5, the unique signal may be selected with a switch 34 which is accessible on the top face of the transmitter housing. Associated with the data encoder is a transmitter 36 which is also situated within the associated transmitter housing. The transmitter is adapted to emit the transmitter coded activation signal via free space upon the receipt thereof only during the receipt of power. An antenna 40 is included to facilitate such transmission. Finally, for supplying power to the transmitter, a one-shot multivibrator 42 is situated within the associated transmitter housing and connected between the motion detector and the transmitter. The connection between the multi-vibrator and the transmitter is afforded by means of a voltage controlled switch 44 for ensuring that proper voltage is supplied to the transmitter. In use, the one-shot multivibrator is adapted to transmit power for a predetermined amount of time upon the receipt of the motion signal. Such predetermined amount of time is afforded by selection of the capacitor and resistor associated with the multi-vibrator. In the preferred embodiment, the predetermined amount of time is less than 100 milliseconds so that the transmission of signals from various motion detector transmitter means will not conflict, as will become apparent later.

Power may be supplied to the transmitter means by two methods the first of which is disclosed hereinabove and employs the plug. In a second embodiment, power may be supplied via a battery thus affording mobility. Another selection switch 50 is included for determining from which source the power is supplied. In the alternative, such may be determined automatically.

Figure 4:
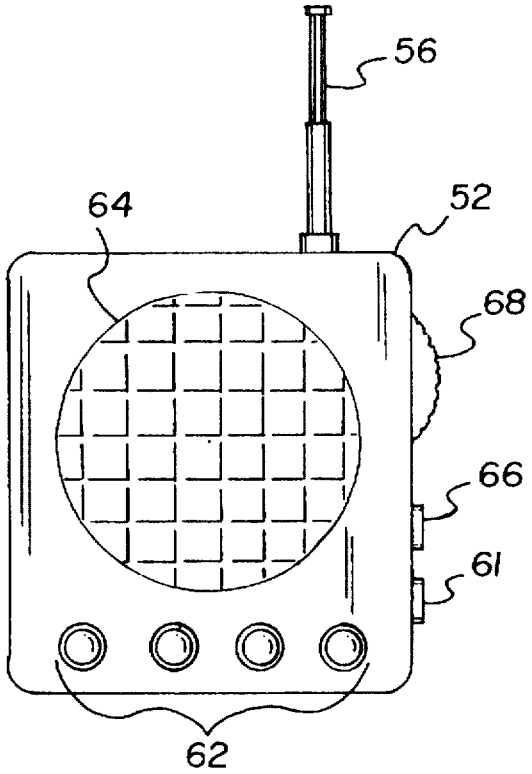
FIG. 4 is a front view of the receiver housing of the present invention.
Figure 6:
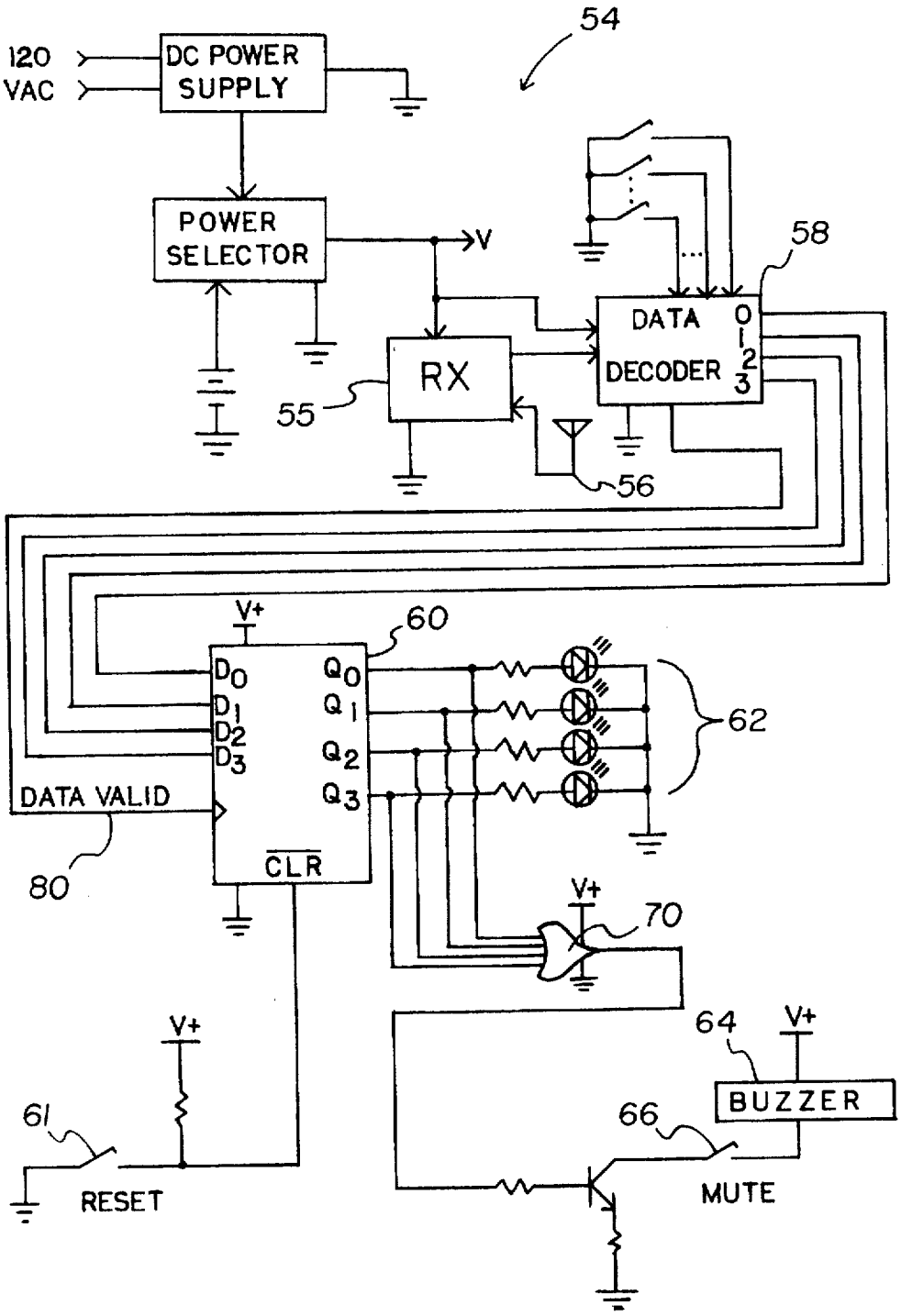
FIG. 6 is a schematic diagram of the receiver means of the present invention.

Further provided is a single receiver unit 52 with a housing having a rectangular configuration. As shown in FIG. 4, the housing of the receiver unit has a front face, a rear face, and a periphery formed therebetween thereby defining an interior space. With reference now to FIG. 6, the receiver unit further has receiver means 54 including a receiver 55 adapted to receive the transmitter coded activation signal via free space. A telescoping antenna 56 is included to facilitate such reception. A data decoder 58 is situated within the receiver housing and is further connected to the receiver. The data decoder has a plurality of outputs. The data decoder functions to transmit a pulse to one of the outputs thereof upon the receipt of a corresponding transmitter coded activation signal. It should be understood that the duration of the pulse corresponds to the duration of the transmitter coded activation signal. Also included as a component of the receiver means is a flip flop 60 situated within the receiver housing with a plurality of inputs thereof connected to the outputs of the data decoder. The flip flop is further equipped with a plurality of outputs. In operation, the flip flop is adapted to transmit a consistent pulse at an output thereof corresponding to the input thereof from which the pulse was received. The flip flop is adapted to emit the pulse from the output thereof until the receipt of a reset pulse received upon the depression of a reset key 61 disposed on the receiver housing of the receiver unit. For providing indication of detected movement to a user, a plurality of light emitting diodes 62 are situated on the front face of the receiver housing and connected to a corresponding output of the flip flop. Each light emitting diode is adapted for emitting light upon the receipt of a pulse. It is imperative that the light emitting diodes be constructed of different colors for allowing the user to easily differentiate which motion detector transmitter means has detected motion. Associated therewith is a buzzer 64 adapted to emit an audible sound upon the receipt of a pulse. The buzzer is equipped with a mute switch 66 accessible to a user on the housing of the receiver for selectively disabling the buzzer and further a dial 68 for selectively determining the volume of the audible sound. While not shown, a jack may be utilized to transmit the audible sound via a head set or ear phone. For controlling the buzzer, a 4-input OR gate 70 is connected between the outputs of the flip flop and the buzzer. The OR gate operates to transmit the pulse to the buzzer upon at least one of the outputs of the flip flop transmitting a pulse.

Similar to the transmitter means, the receiver means may be powered by either a battery or a standard power receptacle. Further, to improve the integrity of the system, both the data encoder and decoder are equipped with selectable system address codes. By this structure, the decoder may verify the address deployed by the encoder. Upon such verification, the decoder deploys a data valid signal via data valid line 80 to the flip flop. Such data valid signal is required before the flip flop transmits a pulse.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved motion detecting system comprising, in combination:

a plurality of transmitter housings each with a generally rectangular configuration with a front face, a rear face, and a periphery formed therebetween thus defining an interior space, the front face having a lower extent with a semi-cylindrical protrusion protruding therefrom, the protrusion having a plurality of horizontal slots formed therein along an entire width of the front face for allowing communication between the interior space and an exterior, the protrusion further having a plurality of flexible shutters adapted to selectively cover a predetermined area of the slots, the transmitter housing further having a rectangular cut out formed in the rear face thereof and a conventional power plug pivotally coupled within the rectangular cut out about a vertical axis, whereby the horizontal slots may be selectively covered and directed towards various areas upon the plug being inserted within a standard power receptacle;

a plurality of motion detector transmitter means situated in each of the transmitter housings, each motion detector transmitter means including:

a motion detector situated within the associated transmitter housing and adapted to emit a motion signal upon the detection of motion via a portion of the slots uncovered by the shutters, a data encoder situated within the associated transmitter housing and connected to the motion detector, the data encoder adapted to emit a transmitter coded activation signal upon the receipt of the motion signal, wherein each transmitter coded activation signal is unique and corresponds with the associated transmitter housing, a transmitter situated within the associated transmitter housing and connected to the data encoder, the transmitter adapted to emit the transmitter coded activation signal via free space upon the receipt thereof only during the receipt of power, and a one-shot multivibrator situated within the associated transmitter housing and connected to the motion detector and the transmitter, the one-shot multivibrator adapted to transmit power for a predetermined amount of time upon the receipt of the motion signal; and a receiver unit including a housing with a rectangular configuration having a front face, a rear face, and a periphery formed therebetween thereby defining an interior space, the receiver unit further having receiver means including:

a receiver adapted to receive the transmitter coded activation signal via free space, a data decoder situated within the receiver housing and connected to the receiver, the data decoder having a plurality of outputs, the data decoder adapted to transmit a pulse to one of the outputs thereof upon the receipt of a corresponding transmitter coded activation signal, wherein the duration of the pulse corresponds to the duration of the transmitter coded activation signal, a flip flop situated within the receiver housing and having a plurality of inputs connected to the outputs of the data decoder and a plurality of outputs, the flip flop adapted to transmit a consistent pulse at an output thereof corresponding to the input thereof from which the pulse was received, the flip flop adapted to emit the pulse from the output thereof until the receipt of a reset pulse received upon the depression of a reset key disposed on the receiver housing of the receiver unit, a plurality of light emitting diodes situated on the front face of the receiver housing and connected to a corresponding output of the flip flop for emitting light upon the receipt of a pulse, a buzzer adapted to emit an audible sound upon the receipt of a pulse, and a 4-input OR gate connected between the outputs of the flip flop and the buzzer, the OR gate adapted to transmit the pulse to the buzzer upon at least one of the outputs transmitting a pulse.

2. A motion detecting system comprising:

a plurality of transmitter housings;

a plurality of motion detector transmitter means situated in each of the transmitter housings, each motion detector transmitter means including:

a motion detector situated within the associated transmitter housing and adapted to emit a motion signal upon the detection of motion, a transmitter situated within the associated transmitter housing, the transmitter adapted to emit a transmitter activation signal via free space upon the transmission of the motion signal and only during the receipt of power, and a one-shot multivibrator means situated within the associated transmitter housing and connected to the motion detector and the transmitter, the one-shot multivibrator means adapted to transmit power for a predetermined amount of time upon the receipt of the motion signal; and a receiver unit including a housing, the receiver unit further having receiver means including:

a receiver adapted to receive the transmitter activation signal via free space and a plurality of light emitting diodes situated on the receiver housing and in communication with the receiver unit for indicating the detection of motion by at least one of the motion detector transmitter means;

wherein each transmitter housing includes a front face, a rear face, and a periphery formed therebetween thus defining an interior space, the front face having a lower extent with a semi-cylindrical protrusion protruding therefrom, the protrusion having a plurality of horizontal slots formed therein along an entire width of the front face for allowing communication between the interior space and an exterior, the protrusion further having a plurality of flexible shutters adapted to selectively cover a predetermined area of the slots.

3. A motion detecting system as set forth in claim 2 and further comprising a buzzer adapted to emit an audible sound upon at least one of the motion detector transmitter means detecting motion.

4. A motion detecting system as set forth in claim 2 wherein each transmitter housing has a rectangular cut out formed in a rear face thereof and a conventional power plug is pivotally coupled within the rectangular cut out about a vertical axis, whereby the transmitter housing motion detector transmitter means may be directed towards various areas upon the plug being inserted within a standard power receptacle.

5. A motion detecting system as set forth in claim 2 wherein the motion detector transmitter means further includes a data encoder situated within the associated transmitter housing and connected to the motion detector, the data encoder adapted to emit a transmitter coded activation signal upon the receipt of the motion signal, wherein each transmitter coded activation signal is unique and corresponds with the associated transmitter housing and is transmitted by the transmitter; and wherein the receiver means further includes:

a data decoder situated within the receiver housing and connected to the receiver which is adapted to receive the transmitter coded activation signal, the data decoder having a plurality of outputs, the data decoder adapted to transmit a pulse to one of the outputs thereof upon the receipt of a corresponding transmitter coded activation signal, wherein the duration of the pulse corresponds to the duration of the transmitter coded activation signal and a flip flop situated within the receiver housing and having a plurality of inputs connected to the outputs of the data decoder and a plurality of outputs, the flip flop adapted to transmit a consistent pulse at an output thereof corresponding to the input thereof from which the pulse was received, the flip flop adapted to emit the pulse from the output thereof until the receipt of a reset pulse received upon the depression of a reset key disposed on the receiver housing of the receiver unit, wherein the light emitting diodes are each connected to a corresponding output of the flip flop.

6. A motion detecting system comprising:

at least one transmitter housings;

at least one motion detector transmitter means situated in each of the transmitter housings, each motion detector transmitter means including:

a motion detector situated within the associated transmitter housing and adapted to emit a motion signal upon the detection of motion, a transmitter situated within the associated transmitter housing, the transmitter adapted to emit a transmitter activation signal via free space upon the transmission of the motion signal and only during the receipt of power, and a one-shot multivibrator means situated within the associated transmitter housing and connected to the motion detector and the transmitter, the one-shot multivibrator means adapted to transmit power for a predetermined amount of time upon the receipt of the motion signal; and a receiver unit including a housing, the receiver unit further having receiver means including:

a receiver adapted to receive the transmitter activation signal via free space and at least one light emitting diode situated on the receiver housing and in communication with the receiver unit for indicating the detection of motion by at least one of the motion detector transmitter means;

said each transmitter housing including a front face, a rear face, and a periphery formed therebetween thus defining an interior space, the front face having a lower extent with a semi-cylindrical protrusion protruding therefrom, the protrusion having a plurality of horizontal slots formed therein along an entire width of the front face for allowing communication between the interior space and an exterior, the protrusion further having a plurality of flexible shutters adapted to selectively cover a predetermined area of the slots.

* * * * *